US009109554B2

(12) United States Patent
Yoon et al.

(10) Patent No.: US 9,109,554 B2
(45) Date of Patent: Aug. 18, 2015

(54) FUEL PUMP MODULE FOR VEHICLE HAVING EXCELLENT FILTERING EFFICIENCY

(71) Applicant: COAVIS, Yeongi-gun (KR)

(72) Inventors: Chanheum Yoon, Yeongi-gun (KR); Wokpyeong Bang, Yeongi-gun (KR)

(73) Assignee: COAVIS (KR)

( * ) Notice: Subject to any disclaimer, the term of this patent is extended or adjusted under 35 U.S.C. 154(b) by 434 days.

(21) Appl. No.: 13/654,596

(22) Filed: Oct. 18, 2012

(65) Prior Publication Data

US 2013/0098339 A1 Apr. 25, 2013

(30) Foreign Application Priority Data

Oct. 19, 2011 (KR) ..... 10-2011-0107118

(51) Int. Cl.

*F02M 37/04* (2006.01)
*F02M 37/10* (2006.01)
*F02M 37/22* (2006.01)

(52) U.S. Cl.

CPC ..... *F02M 37/04* (2013.01); *F02M 37/106* (2013.01); *F02M 2037/225* (2013.01)

(58) Field of Classification Search

CPC ..... F01N 2610/02; F01N 2610/1406; F01N 2610/1426; F02M 37/103; F02M 37/106; F02M 59/44; F02M 2037/225

USPC ..... 123/495, 497, 509, 510; 417/423.3, 417/423.9, 423.15

See application file for complete search history.

(56) References Cited

U.S. PATENT DOCUMENTS

| | | | | |
|---|---|---|---|---|
| 5,392,750 | A * | 2/1995 | Laue et al. | 123/509 |
| 5,564,396 | A * | 10/1996 | Kleppner et al. | 123/509 |
| 5,699,773 | A * | 12/1997 | Kleppner et al. | 123/510 |
| 6,206,037 | B1 * | 3/2001 | Murakoshi et al. | 137/565.34 |
| 6,453,882 | B2 * | 9/2002 | Schreckenberger | 123/509 |
| 6,837,222 | B2 * | 1/2005 | Okazono et al. | 123/509 |
| 6,928,989 | B2 * | 8/2005 | Powell | 123/509 |
| 6,981,490 | B2 * | 1/2006 | Nagata et al. | 123/514 |
| 7,398,769 | B2 * | 7/2008 | Athalye | 123/509 |
| 8,469,008 | B2 * | 6/2013 | Powell et al. | 123/509 |
| 8,919,326 | B2 * | 12/2014 | Lim et al. | 123/509 |
| 2002/0083929 | A1 * | 7/2002 | Koller et al. | 123/509 |
| 2008/0053412 | A1 * | 3/2008 | Suzuki | 123/497 |
| 2010/0206793 | A1 * | 8/2010 | Oku et al. | 210/172.4 |
| 2011/0174275 | A1 * | 7/2011 | Lim et al. | 123/509 |

FOREIGN PATENT DOCUMENTS

| | | |
|---|---|---|
| JP | 2009068420 | 4/2009 |
| KR | 1999003283 | 1/1999 |
| KR | 1020060069662 | 6/2006 |

* cited by examiner

*Primary Examiner* — John Kwon
*Assistant Examiner* — Johnny H Hoang
(74) *Attorney, Agent, or Firm* — Cantor Colburn LLP

(57) ABSTRACT

Provided is a fuel pump module for a vehicle includes: a flange assembly positioned at a top portion of a fuel tank; a reservoir body assembly positioned at an inner bottom portion of the fuel tank; and a guide rod connecting the flange assembly and the reservoir body assembly to each other, wherein the reservoir body assembly includes: a fuel pump forcibly supplying fuel in the fuel tank to an engine; and a filter having a column shape in which it includes a hollow having the fuel pump positioned therein, installed in a form in which it is inserted into a case forming an appearance of the reservoir body assembly and having the fuel pump installed therein, and installed to allow the fuel before passing through the fuel pump to pass therethrough, thereby filtering foreign materials included in the fuel.

4 Claims, 6 Drawing Sheets

(A)

(B)

FUEL PUMP MODULE FOR VEHICLE HAVING EXCELLENT FILTERING EFFICIENCY

CROSS-REFERENCE TO RELATED APPLICATIONS

This application claims priority under 35 U.S.C. §119 to Korean Patent Application No. 10-2011-0107118, filed on Oct. 19, 2011, in the Korean Intellectual Property Office, the disclosure of which is incorporated herein by reference in its entirety.

TECHNICAL FIELD

The following disclosure relates to a fuel pump module for a vehicle positioned in a fuel tank of the vehicle to supply fuel to an engine.

BACKGROUND

A vehicle driven by receiving liquid fuel, such as a gasoline engine or a diesel engine, is provided with a fuel tank in which fuel is stored.

In addition, the vehicle is provided with a fuel pump module forcibly supplying the fuel filled in the fuel tank to the engine.

Generally, as shown in FIGS. 1 and 2, the fuel pump module is configured to include a flange assembly 1, a reservoir body assembly 2, a guide rod 3 connecting the flange assembly and the reservoir body assembly to each other, a spring 4 positioned at an outer side of the guide rod 3, and a filter (a primary filter 5*a* and a secondary filter 5*b*) filtering foreign materials included in the fuel tank.

This structure may be confirmed in Korean Utility Model Application No. 20-1997-0016877 (Korean Utility Model Registration No. 20-0160774), or the like.

In most cases, the flange assembly 1 is fixed to an inlet portion of the fuel tank and the reservoir body assembly 2 is positioned at the bottom of the fuel tank.

In addition, the guide rod, which connects the flange assembly and the reservoir body assembly to each other while guiding movement of the spring, is configured to slidably move to an inner side of the reservoir body assembly.

Further, the spring is positioned at the outer side of the guide rod, and is positioned between the flange assembly and the reservoir body assembly to allow the reservoir body assembly to be always positioned on the bottom of the fuel tank.

Further, the filter is configured of a primary filter 5*a* filtering foreign materials in the fuel before being supplied to the fuel pump and a secondary filter 5*b* filtering foreign materials in the fuel passing through the fuel pump 7.

In addition, the secondary filter 5*b* is an in-tank filter having a form in which it is embedded in a case including an upper case and a lower case.

The reason why the fuel pump module includes both of the primary and secondary filters is to minimize a load acting on the fuel pump, or the like, which is increased as sizes of the foreign materials capable of being filtered by the filter become small, and improve filtering efficiency.

However, even though the fuel pump module is implemented to include the primary and secondary filters as described above, since there is a limitation in increasing a size of the primary filter in view of characteristics of the fuel pump module and the secondary filter has an in-tank filter form, necessity for a structure capable of increasing a lifespan while further improving filtering efficiency has been increased.

In addition, the secondary filter having the in-tank filter form may be damaged while being used, such as generation of a swelling phenomenon, or the like, due to high temperature and high pressure, and it is inconvenient to replace and repair the secondary filter.

Meanwhile, according to the related art, the guide rod is made only of a metal, such that a material cost, a labor cost, and the like, increase, thereby making payability bad.

Particularly, lengths of the guide rods are different from each other according to a specification of the fuel pump module. Therefore, since manufacturers should secure guide rods having various lengths in order to provide guide rods appropriate for each fuel pump module, an economical burden increases.

In addition, since the guide rod is relatively stronger than the flange assembly or the reservoir body assembly that is made of a synthetic resin material due to characteristics of a material thereof, a shear inducing part allowing damage to be generated in order to prevent leakage of the fuel in a situation such as generation of traffic accident, or the like, is formed at the flange assembly, such that a cost required for repairing and replacing the fuel pump module increases.

Further, a snap ring for assembling the guide rod to the flange assembly and the reservoir body assembly is required, and a groove for installing the snap ring should be formed in the guide rod.

RELATED ART DOCUMENT

Patent Document (Patent Document 1) Korean Utility Model Application No. 20-1997-0016877 (Korean Utility Model Registration No. 20-0160774)

SUMMARY

An embodiment of the present invention is directed to providing a fuel pump module for a vehicle capable of minimizing the number of filters by securing a wide filtering area, having significantly excellent filtering efficiency, generating a low load in a component such as a fuel pump, or the like, having a long lifespan, and easily repairing and replacing the filters.

Another embodiment of the present invention is directed to providing a fuel pump module for a vehicle capable of having good payability and allowing an economical burden according to securing of an inventory not to increase by including a guide rod that may be cut and used at an appropriate length according to a specification of the fuel pump module.

In an exemplary embodiment of the present invention, a fuel pump is positioned in a filter entirely having a column shape in which it includes a hollow space formed therein, installed in a form in which it is inserted into a case forming an appearance of a reservoir body assembly and having the fuel pump installed therein, and installed to allow fuel before passing through the fuel pump to pass therethrough, thereby filtering foreign materials included in the fuel.

Therefore, it is possible to provide a fuel pump module capable of obtaining excellent filtering efficiency, generating a low load in the fuel pump, having a long lifespan, and easily repairing and replacing the filters even with a single filter.

In addition, a guide rod extruded using a synthetic resin material is used, such that payability is good and an economical burden according to securing of an inventory does not increase.

The fuel pump module for a vehicle according to the exemplary embodiment of the present invention as described above includes a flange assembly positioned at a top portion of a fuel tank.

In addition, the fuel pump module for a vehicle according to the exemplary embodiment of the present invention includes a reservoir body assembly positioned at an inner bottom portion of the fuel tank.

Further, the fuel pump module for a vehicle according to the exemplary embodiment of the present invention includes a guide rod connecting the flange assembly and the reservoir body assembly to each other.

The reservoir body assembly includes a fuel pump forcibly supplying fuel in the fuel tank to an engine.

In addition, the reservoir body assembly includes a filter entirely having a column shape in which it includes a hollow space formed therein, installed in a form in which it is inserted into a case forming an appearance of a reservoir body assembly and having the fuel pump installed therein, and installed to allow fuel before passing through the fuel pump to pass therethrough, thereby filtering foreign materials included in the fuel.

BRIEF DESCRIPTION OF THE DRAWINGS

FIG. 6 is a schematic view showing an example of a guide rod corresponding to a component according to the exemplary embodiment of the present invention, wherein FIG. 6A is a perspective view of a guide rod having a hollow space divided by a rib; and FIG. 6B is a cross-sectional view of a guide rod in which strength reinforcing bodies are positioned at predetermined intervals in a length direction and a damage inducting part is formed.

[Detailed Description of Main Elements]

| | |
|---|---|
| 1: Flange assembly | 2: Reservoir body assembly |
| 3: Guide rod | 4: Spring |
| 5a: Primary filter | 5b: Secondary filter |
| 7: Fuel pump | 10: Flange assembly |
| 20: Reservoir body assembly | 21: Fuel Pump |
| 22: Filter | 22a: Hollow |
| 22b: Air gap forming body | 22c, 22g: Finishing material |
| 22d: Deformation preventing member | 22e: Filter case |
| | 23: Filter case |
| 22f: Hole | 25: Jet pump |
| 24: Packing | 30: Guide rod |
| 26: Pressure regulator | 32: Hollow |
| 31: Rib | 34: Shear inducing part |
| 33: Strength reinforcing body | 50: Diaphragm |
| 40: Spring | |
| 60: Check valve | |

DETAILED DESCRIPTION OF EMBODIMENTS

Hereinafter, a technical spirit of the present invention will be described in more detail with reference to the accompanying drawings.

However, the accompanying drawings are only examples shown in order to describe the technical idea of the present invention in more detail. Therefore, the technical idea of the present invention is not limited to shapes of the accompanying drawings.

The present invention relates to a fuel pump module.

Figure 1:
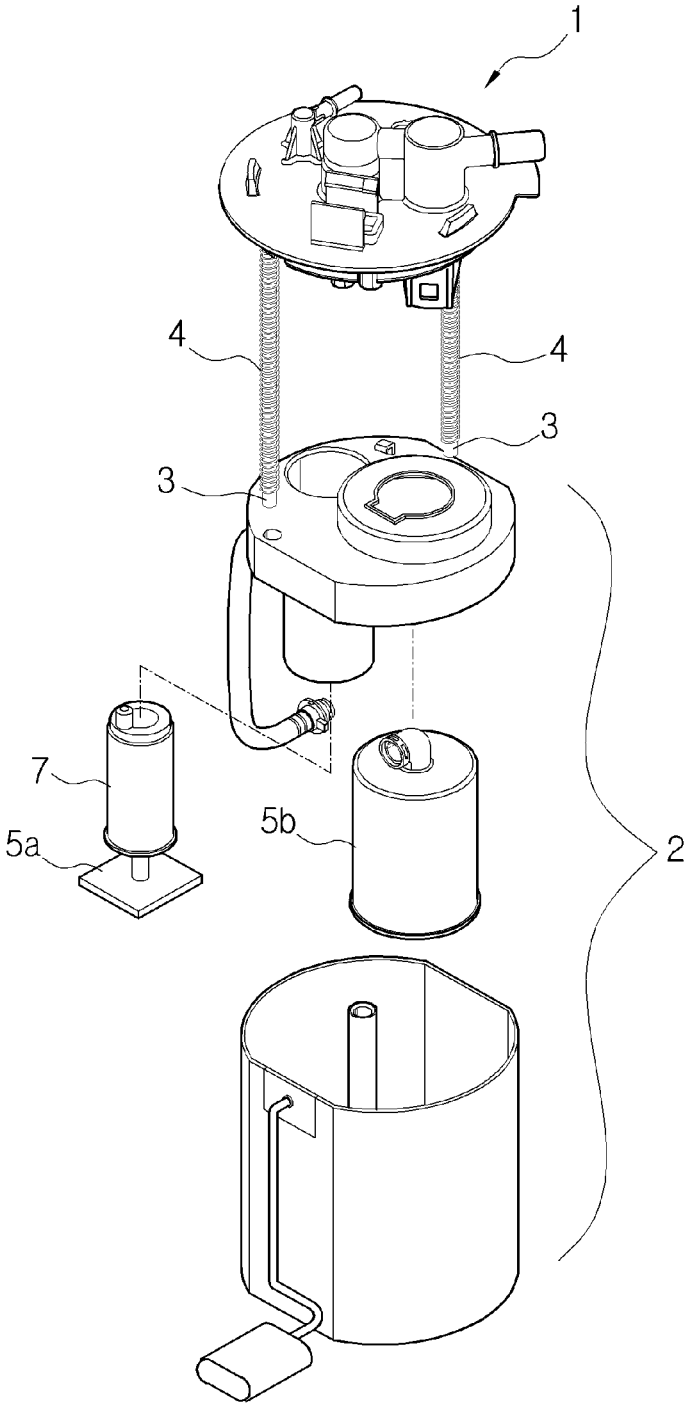
FIG. 1 Prior art
FIG. 1 is an exploded perspective view for describing a fuel pump module according to the related art.
Figure 2:
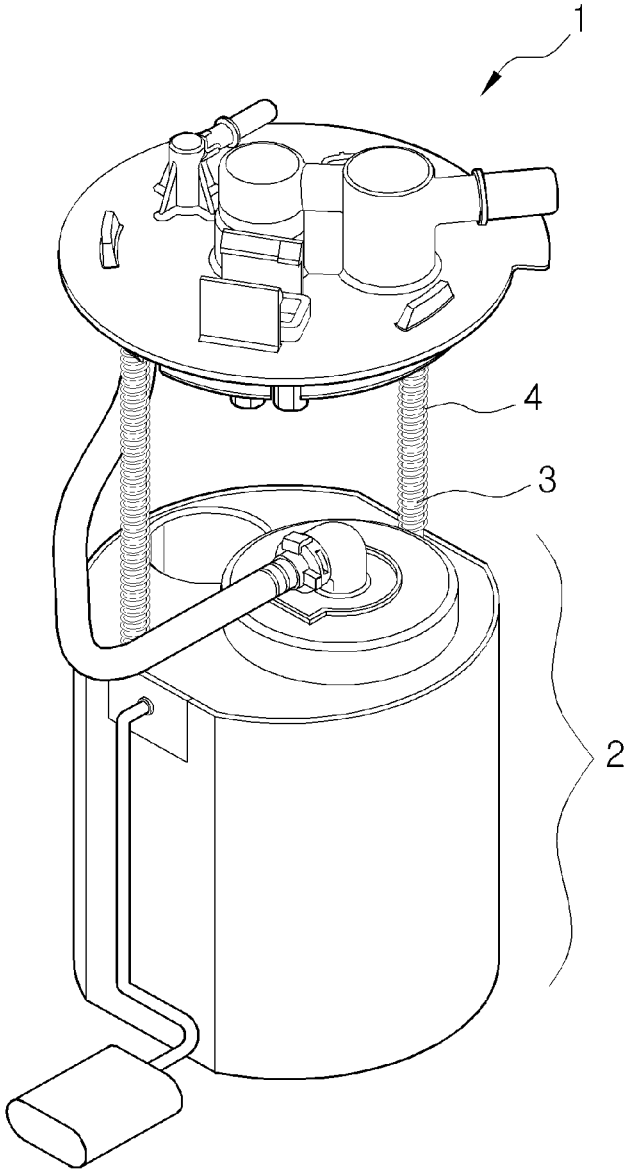
FIG. 2 Prior art
FIG. 2 is a perspective view of the fuel pump module according to the related art.
Figure 3:
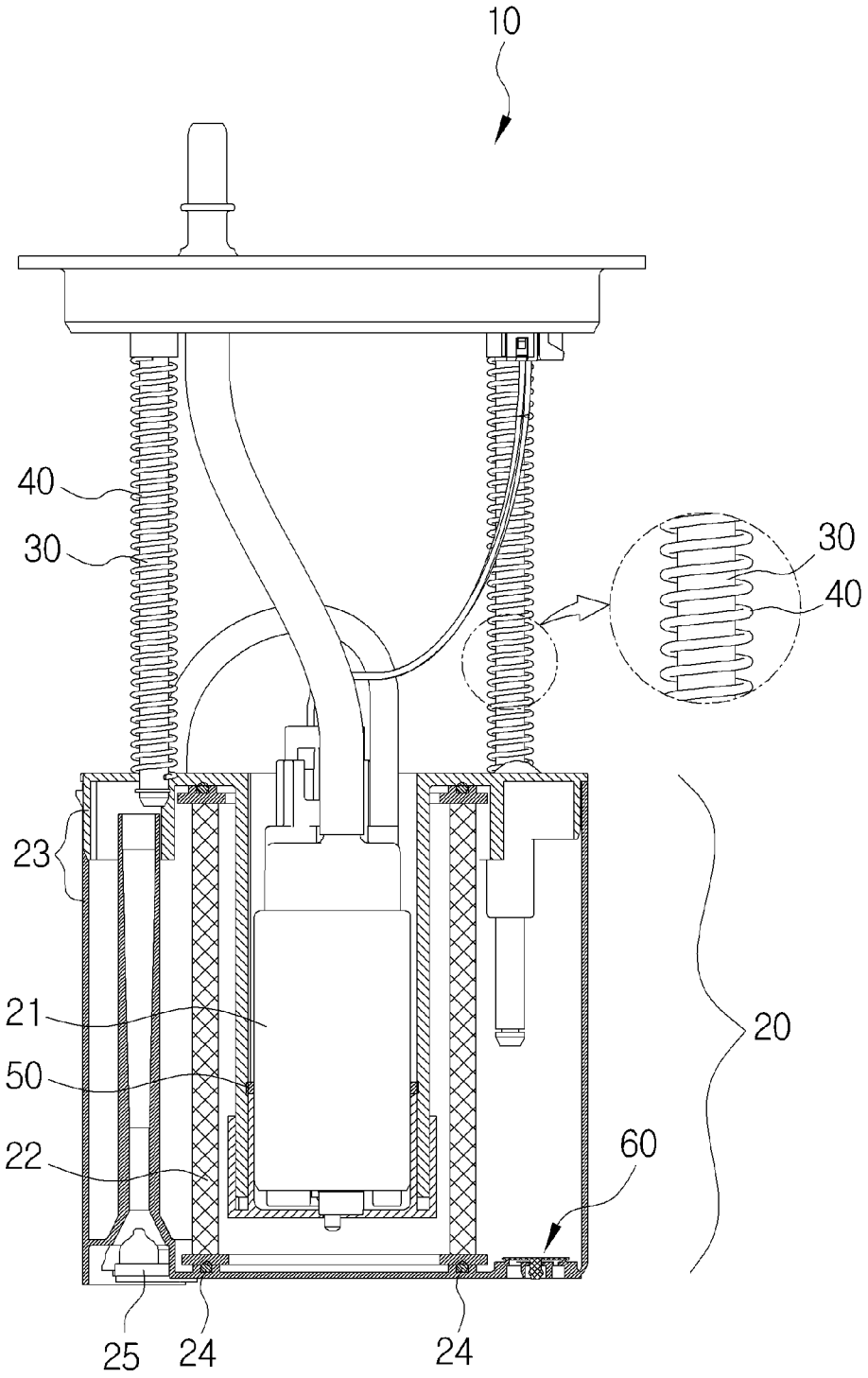
FIG. 3 is a schematic cross-sectional view for describing a fuel pump module according to an exemplary embodiment of the present invention.

Therefore, as shown in FIG. 3, a fuel pump module according to an exemplary embodiment of the present invention includes a flange assembly 10 positioned on a top portion of a fuel tank, similar to the fuel pump module according to the related art.

In addition, the fuel pump module according to the exemplary embodiment of the present invention includes a reservoir body assembly 20 positioned on an inner bottom portion of the fuel tank.

Further, the fuel pump module according to the exemplary embodiment of the present invention includes a guide rod 30 connecting the flange assembly 10 and the reservoir body assembly 20 to each other.

Further, the reservoir body assembly 20 includes a fuel pump 21 forcibly supplying fuel in the fuel tank to an engine.

Meanwhile, an object of the present invention is to provide a fuel pump module for a vehicle that may minimize the number of filters by securing a wide filtering area, have significantly excellent filtering efficiency, generate a low load in a component such as a fuel pump, or the like, have a long lifespan, and easily repair and replace the filters.

Therefore, the fuel pump module according to the exemplary embodiment of the present invention includes a filter 22 filtering foreign materials included in the fuel.

Further, since the minimum number of filters are used, the filter 22 is installed to filter the foreign materials included in the fuel before passing through the fuel pump 21.

That is, the fuel in the fuel tank passes through the filter 22 according to the exemplary embodiment of the present invention and then moves to the fuel pump 21, and the filter 22 is installed at a position before the fuel arrives at the fuel pump 21 in a movement path of the fuel.

According to the related art, the primary filter primarily is configured to filter foreign materials included in the fuel before arriving at the fuel pump, and the secondary filter is configured to filter fine foreign materials included in the fuel passing through the fuel pump.

The present inventor has made an effort to devise a filter capable of satisfying conditions such as generation of a low load and minimization of the number of filters by paying attention to the fact that when a wide filtering area may be secured even in a filter (an MRA filter, or the like) capable of filtering fine foreign materials by including air gaps having a significantly small size, the low load is generated in a component such as a fuel pump, or the like, and the number of filters may be minimized.

Most of all, the filter needs to be used without significantly changing forms of other components configuring the fuel pump module.

Figure 4:
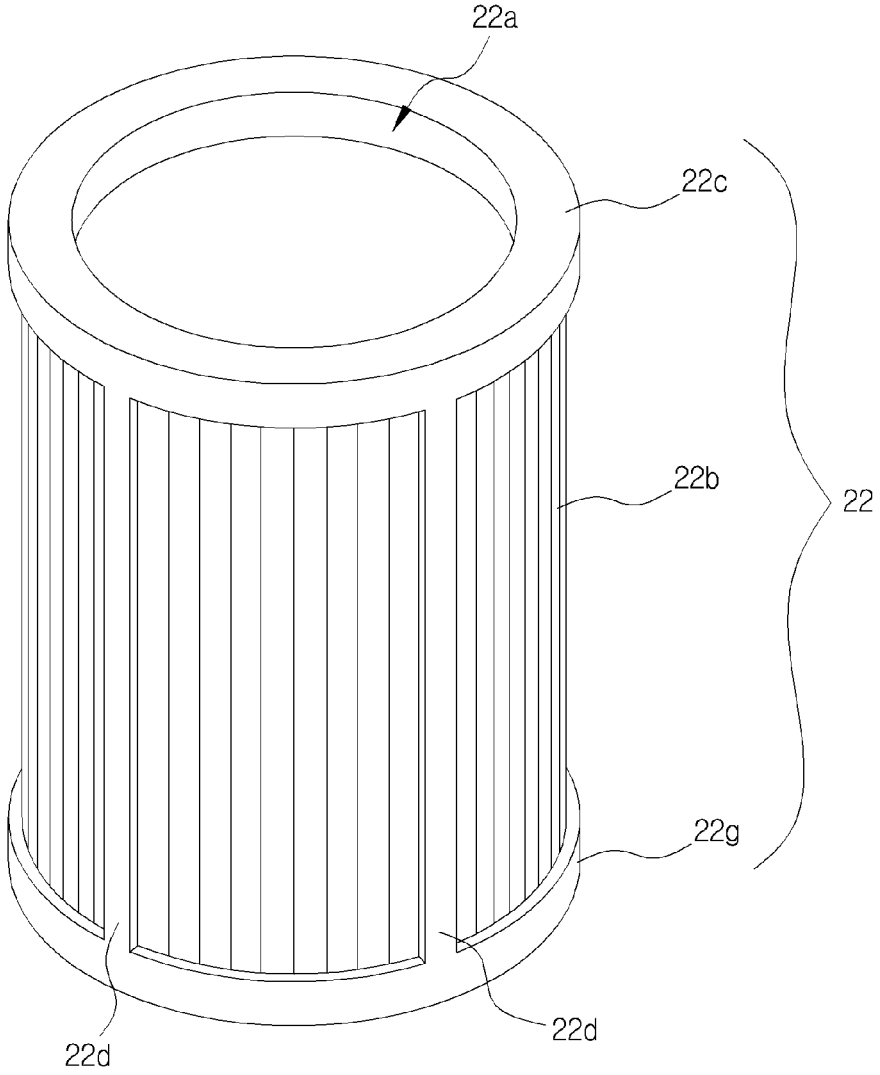
FIG. 4 is a schematic perspective view for describing a filter according to the exemplary embodiment of the present invention having a deformation preventing member.

As shown in FIG. 4, the filter 22 according to the exemplary embodiment of the present invention satisfying the above-mentioned condition entirely has a column (a cylindrical column or a prismatic column) shape in which it includes a hollow space 22*a* formed therein, such that the fuel pump 21 may be positioned in the hollow space 22*a*.

In addition, the filter 22 is installed in a form in which it is inserted into a case 23 forming an appearance of the reservoir body assembly 20 and having the fuel pump installed therein.

In the filter 22 according to the exemplary embodiment of the present invention described above, since a significantly wide filtering area is secured, even though air gaps (air gaps for filtering) formed through an air gap forming body 22*b* are significantly small to be capable of filtering fine foreign materials, an overload is not generated in the fuel pump 21.

In addition, deformation of other components configuring the fuel pump module may be minimized.

Even though the filter according to the exemplary embodiment of the present invention as described above is used, in order to allow the filter to perfectly perform its function, it is required to allow fuel not to move to the fuel pump 21 without passing through the air gaps of the air gap forming body 22*b*.

Further, it is required to facilitate separation for installation and replacement of the filter 22.

To this end, an upper end portion and a lower end portion of the filter 22 are closely adhered and blocked to components of the reservoir body assembly 20, thereby making it possible to allow the fuel to pass only between the upper end portion and the lower end portion of the filter 22.

Figure 5:
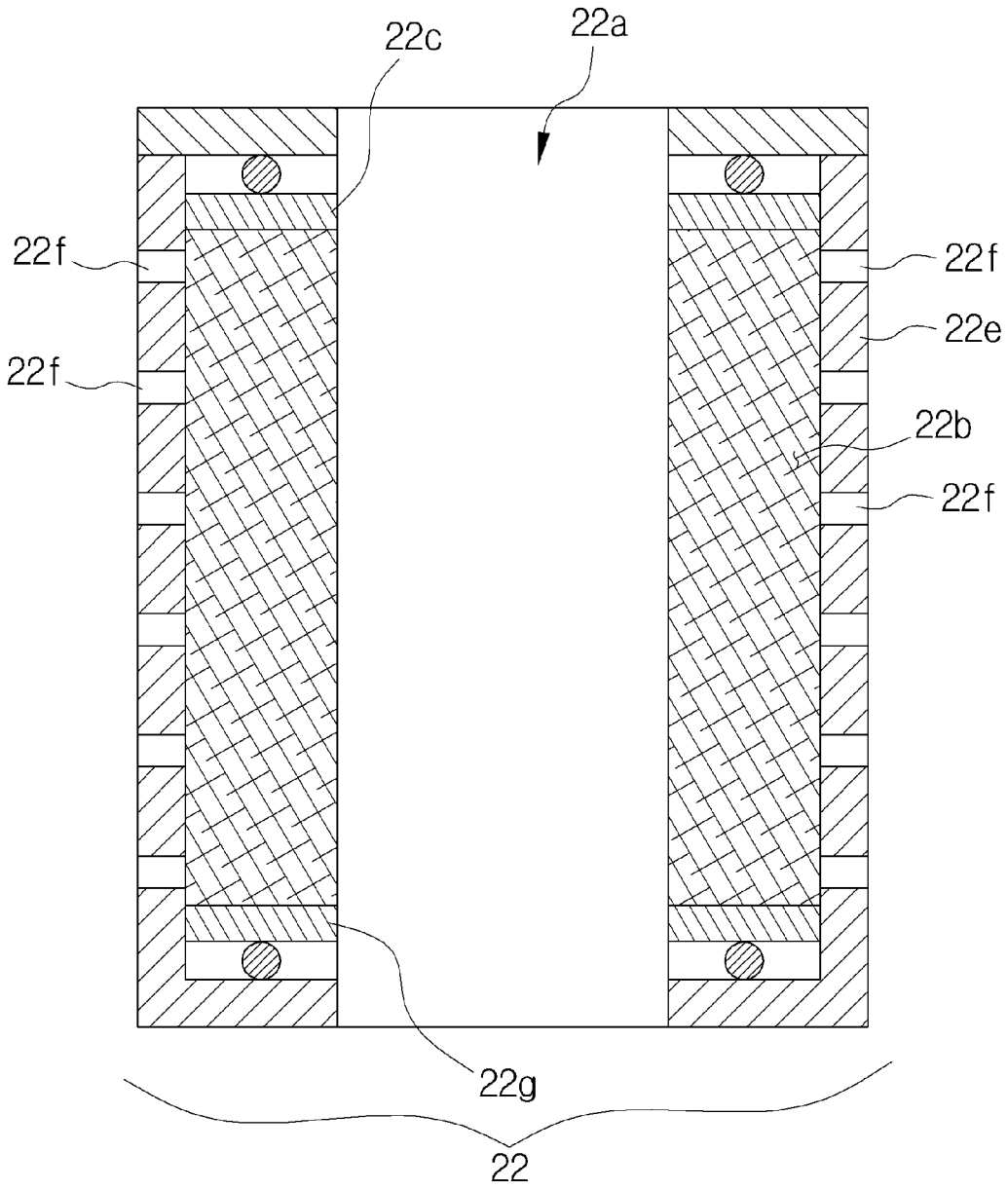
FIG. 5 is a schematic view for describing a filter having a form in which an air gap forming body is inserted in a filter case having holes perforated therein.

As shown in FIG. 5, the filter 22 as described above includes finishing materials 22*c* and 22*g* each installed at an upper end portion and a lower end portion of the air gap forming body 22*b* forming the air gaps, thereby making it possible to prevent the upper end portion and the lower end portion of the air gap forming body 22*b* from being damaged.

These finishing materials 22*c* and 22*g* may be made of a synthetic resin material, rubber, or a metal. In addition, when surfaces of the finishing materials 22*c* and 22*g* contacting other components are smoothed, the finishing materials 22*c* and 22*g* may be firmly closely adhered to other components.

As shown in FIG. 3, the reservoir body assembly 20 includes a packing 24 positioned at an installation position of the filter 22 and upper and lower portions of the filter are closely adhered to the packing 24, such that firm close adhesion may be made (the packing 24 may be general an O-ring).

However, the air gap forming body 22*b* forming the air gaps filtering the foreign materials generally has a disadvantage in that rigidity is weak.

In order to solve this disadvantage, the filter 22 may further include deformation preventing members 22*d* connecting the finishing materials 22*c* and 22*g* each installed at the upper end portion and the lower end portion of the air gap forming body 22*b* to each other and disposed at predetermined intervals.

As the number of deformation preventing members 22*d* increases, rigidity of the filter increases, but a filtering speed thereof decreases.

As another structure of the filter for increasing the rigidity of the filter, the filter may have a structure in which the air gap forming body 22*b* forming the air gaps may be inserted into a hollow space of a filter case 22*e* having a plurality of holes 22*f* perforated between upper and lower end portions thereof.

In this structure, as the number of perforated holes 22*f* increases, the filtering speed of the filter increases, but the rigidity of the filter decreases.

Figure 6:
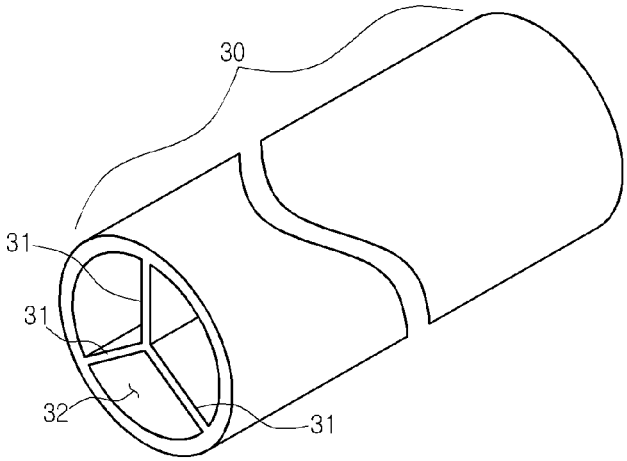
Figure 6:
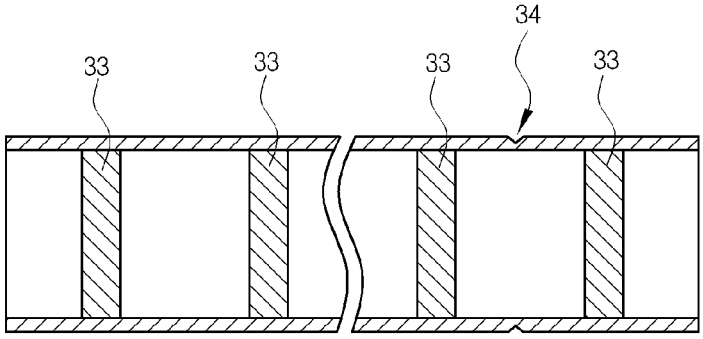

Meanwhile, according to the exemplary embodiment of the present invention, as shown in FIG. 6, the fuel pump module includes the guide rod 30 that may be cut and used at an appropriate length according to a specification of the fuel pump module, such that it may have good payability and may allow an economical burden according to securing of an inventory not to increase.

To this end, in the exemplary embodiment of the present invention, the guide rod 30 extruded using a synthetic resin may be used.

That is, the guide rod 30 extruded using the synthetic resin may be easily cut and used so as to have an appropriate length according to the specification of the fuel pump module.

In addition, since the flange assembly 10 the reservoir body assembly 20 is made of a synthetic resin material, the guide rod 30 may be easily and firmly coupled (assembled) to the flange assembly 10 or the reservoir body assembly 20 by a fusing method, or the like.

In addition, since the extruded long guide rod 30 is prepared and then cut and used according to the specification of the fuel pump module, a burden for an inventory and a burden of preparing each of the molds for molding may be reduced in terms of a manufacturer.

However, the guide rod needs to satisfy a predetermined strength condition. For example, the guide rod should endure predetermined warpage stress.

As a material for extruding the guide rod 30, a high strength material such as a glass fiber, or the like, may be used. The above-mentioned material is insufficient to reinforce strength due to characteristics thereof.

Therefore, a guide rod 30 extruded in a form in which it has a hollow space 32 divided by ribs 31 as shown in FIG. 6A may be used.

In addition, a guide rod 30 extruded so that strength reinforcing bodies 33 are positioned at predetermined intervals in a length direction may also be used.

That is, the guide rod 30 may be extruded so that the strength reinforcing bodies 33 made of a material such as a metal, carbon nano composite fiber, or the like, having strength relatively stronger than a general synthetic resin, particularly, a main material for extruding the guide rod 30 according to the exemplary embodiment of the present invention are inserted.

Since the strength reinforcing bodies 33 as described above are positioned at predetermined intervals, when a cut point of the guide rod 30 is a point between the strength reinforcing bodies 33, the guide rod 30 may be cut to have a length appropriate for the specification of the fuel pump module.

The guide rod 30 may also be implemented in a structure in which it has both of the hollow space 32 divided by the ribs 31 and the strength reinforcing bodies 33.

As a method of extruding the guide rod so that the strength reinforcing bodies 33 are positioned therein, a method of injecting a material into a hollow space of a raw material extruded in a general extrusion field may be used.

The guide rod 30 may be configured to conduct current.

The guide rod 30 conducting the current may be implemented by mixing a conductive material such as carbon, or the like, with a synthetic resin raw material for extrusion and extruding the mixed raw material.

In the case in which the guide rod 30 conducts the current, a static electricity preventing effect may be obtained.

According to the exemplary embodiment of the present invention, a shear inducing part 34 having shear strength lower than that of a connection portion with the flange assembly 10 or a connection portion with the reservoir body assembly 20 may be formed between the connection portion with the flange assembly 10 and the connection portion with the reservoir body assembly 20 in the guide rod 30.

That is, the fuel pump module for a vehicle is generally provided with the shear inducing part so that in the case in which impact is applied, shear is generated at a lower point of the flange assembly 10 to prevent other portions from being damaged, as a unit for preventing leakage of fuel in a situation such as a traffic accident, or the like.

According to the related art, the shear inducing part has been formed in the flange assembly itself. However, this structure makes a repairing and replacing work difficult and causes an increase in a replacement cost.

As in the exemplary embodiment of the present invention, in the case in which the shear inducing part 34 is formed in the guide rod 30, the guide rod 30 that is relatively inexpensive and may be easily repaired rather than the flange assembly 10 or the reservoir body assembly 20 is damaged at the time of generation of the impact due to the traffic accident, or the like, thereby making it possible to reduce a cost required for repair and replacement while preventing the leakage of the fuel.

Reference numeral 40 that is not described indicates a spring having a shape in which the guide rod 30 is inserted thereinto and pushing the flange assembly 10 and the reservoir body assembly 20 in a direction opposite to each other.

In addition, reference numeral 25 indicates a jet pump.

Further, reference numeral 50 indicates a diaphragm for preventing the fuel from being introduced into the fuel pump 21 through a space between the filter case 23 and the fuel pump 21. The diaphragm may be implemented in a form such as a packing, an oil seal, or the like.

Further, reference numeral 60 indicates a check valve allowing the fuel in the fuel tank to be introduced into the filter case 23 and allowing the fuel not to be discharged therefrom.

The fuel pump module for a vehicle according to the exemplary embodiment of the present invention includes the filter filtering the foreign materials included in the fuel pump. The filter has the column shape in which it includes the hollow space formed therein, is installed in a form in which it is inserted into the case having the fuel pump installed therein, and is installed to allow the fuel before passing through the fuel pump to pass therethrough, thereby filtering the foreign materials included in the fuel, and the fuel pump is positioned in the hollow space. Therefore, it is possible to provide a fuel pump module capable of obtaining excellent filtering efficiency, generating a low load in the fuel pump, having a long lifespan, and easily repairing and replacing the filters even with a single filter.

In addition, the guide rod extruded using a synthetic resin material is used, such that the payability is good and the economical burden according to the securing of the inventory does not increase.

What is claimed is:

1. A fuel pump module for a vehicle having excellent filtering efficiency, comprising:

a flange assembly positioned at a top portion of a fuel tank;

a reservoir body assembly positioned at an inner bottom portion of the fuel tank; and a guide rod connecting the flange assembly and the reservoir body assembly to each other, wherein the reservoir body assembly includes:

a fuel pump forcibly supplying fuel in the fuel tank to an engine; and a filter having a column shape having a hollow space in which the fuel pump is installed, the filter being inserted into a case forming an appearance of the reservoir body assembly so as to allow the fuel to pass through the filter before passing through the fuel pump, thereby filtering foreign materials included in the fuel, wherein the filter includes:

an air gap forming body forming air gaps and provided in the hollow space;

finishing materials each provided at an upper end portion and a lower end portion of the air gap forming body, thereby being closely adhered to the reservoir body assembly, and preventing the upper end portion and the lower end portion of the air gap forming body from being damaged;

a packing provided between the finishing material at the upper end portion of the air gap forming body and the reservoir body assembly, or between the finishing material at the lower end portion of the air gap forming body and the reservoir body assembly, so that upper and lower end portions of the filter are closely adhered to the reservoir body assembly, and being formed to allow the fuel to pass only between the upper end portion and the lower end portion of the filter; and deformation preventing members connecting the finishing materials installed at the upper end portion and the lower end portion respectively and disposed at predetermined intervals.

2. The fuel pump module for a vehicle having excellent filtering efficiency of claim 1, wherein the guide rod is extruded using a synthetic resin material.

3. A fuel pump module for a vehicle having excellent filtering efficiency, comprising:

a flange assembly positioned at a top portion of a fuel tank;

a reservoir body assembly positioned at an inner bottom portion of the fuel tank; and a guide rod connecting the flange assembly and the reservoir body assembly to each other, wherein the reservoir body assembly includes:

a fuel pump forcibly supplying fuel in the fuel tank to an engine; and a filter having a column shape having a hollow space in which the fuel pump is installed, the filter being inserted into a case forming an appearance of the reservoir body assembly so as to allow the fuel to pass through the filter before passing through the fuel pump, thereby filtering foreign materials included in the fuel, wherein the filter includes:

an air gap forming body forming air gaps and provided in the hollow space;

finishing materials each provided at an upper end portion and a lower end portion of the air gap forming body, thereby being closely adhered to the reservoir body assembly, and preventing the upper end portion and the lower end portion of the air gap forming body from being damaged;

a packing provided between the finishing material at the upper end portion of the air gap forming body and the reservoir body assembly, or between the finishing material at the lower end portion of the air gap forming body and the reservoir body assembly, so that upper and lower end portions of the filter are closely adhered to the reservoir body assembly, and being formed to allow the fuel to pass only between the upper end portion and the lower end portion of the filter; and a filter case having a plurality of holes perforated between upper and lower end portions of the filter provided in the hollow space.

4. The fuel pump module for a vehicle having excellent filtering efficiency of claim 3, wherein the guide rod is extruded using a synthetic resin material.

* * * * *